US008608447B2

(12) United States Patent
LaBelle et al.

(10) Patent No.: US 8,608,447 B2
(45) Date of Patent: Dec. 17, 2013

(54) DISK FOR TURBINE ENGINE

(75) Inventors: Joseph Benjamin LaBelle, Fishers, IN (US); Christopher Hall, Indianapolis, IN (US); Samuel J. LaCombe, Indianapolis, IN (US); James C. Muskat, Mooresville, IN (US)

(73) Assignee: Rolls-Royce Corporation, Indianapolis, IN (US)

( * ) Notice: Subject to any disclaimer, the term of this patent is extended or adjusted under 35 U.S.C. 154(b) by 1338 days.

(21) Appl. No.: 12/388,574

(22) Filed: Feb. 19, 2009

(65) Prior Publication Data

US 2010/0209252 A1 Aug. 19, 2010

(51) Int. Cl.
*B63H 1/28* (2006.01)
*B63H 13/00* (2006.01)

(52) U.S. Cl.
USPC ..... 416/216; 416/203; 416/219 R

(58) Field of Classification Search
USPC ..... 416/204 A, 203, 216, 219 R; 29/889.23
See application file for complete search history.

(56) References Cited

U.S. PATENT DOCUMENTS

| | | | | |
|---|---|---|---|---|
| 952,317 | A | | 3/1910 | Eyermann |
| 1,640,451 | A | | 8/1927 | Jungren |
| 2,225,769 | A | | 12/1940 | Conrad |
| 2,821,357 | A | | 1/1958 | Schorner |
| 3,295,826 | A | | 1/1967 | Nickles |
| 3,904,316 | A | | 9/1975 | Clingman et al. |
| 4,349,318 | A | | 9/1982 | Libertini et al. |
| 4,460,315 | A | | 7/1984 | Tseng et al. |
| 4,629,976 | A | * | 12/1986 | Pipkorn ..... 324/72.5 |
| 5,141,401 | A | | 8/1992 | Juenger et al. |
| 5,174,720 | A | | 12/1992 | Gradl |
| 5,310,318 | A | * | 5/1994 | Lammas et al. ..... 416/219 R |
| 5,395,213 | A | * | 3/1995 | Stenneler ..... 416/219 R |
| 5,431,542 | A | | 7/1995 | Weisse et al. |
| 5,993,162 | A | | 11/1999 | Weisse et al. |
| 6,019,579 | A | | 2/2000 | Fukuno et al. |
| 6,033,185 | A | | 3/2000 | Lammas et al. |
| 6,471,483 | B2 | | 10/2002 | London |
| 7,080,974 | B2 | | 7/2006 | Lejars et al. |
| 7,306,433 | B2 | | 12/2007 | Klingels et al. |
| 7,399,164 | B2 | | 7/2008 | Scharl |
| 7,416,394 | B2 | | 8/2008 | Ahmad et al. |
| 7,442,007 | B2 | | 10/2008 | Bibor et al. |
| 7,476,083 | B2 | | 1/2009 | Snook et al. |
| 7,476,084 | B1 | | 1/2009 | Chan et al. |
| 7,476,085 | B2 | | 1/2009 | Mohr et al. |
| 7,549,846 | B2 | | 6/2009 | Dube et al. |
| 2003/0129060 | A1 | * | 7/2003 | Knott et al. ..... 416/219 R |
| 2009/0116964 | A1 | * | 5/2009 | Brock ..... 416/179 |
| 2010/0284816 | A1 | * | 11/2010 | Propheter-Hinckley et al. ..... 416/241 B |

OTHER PUBLICATIONS

Davidson, David L., Gas Turbine Disk-Blade Attachment Crack, Journal of Failure Analysis and Prevention vol. 5(1) Feb. 2005, pp. 55-71.

* cited by examiner

*Primary Examiner* — Nitin Parekh
(74) *Attorney, Agent, or Firm* — Krieg DeVault LLP

(57) ABSTRACT

A disk for a turbine engine is disclosed herein. The disk includes a rotatable body extending along a longitudinal axis between a forward side and an aft side. The disk also includes a plurality of slots disposed about a periphery of the body. Each of the slots extends between the forward and aft sides along a respective slot axis. The sides of each of the slots are asymmetrical relative to one another in a cross-section normal to the slot axis.

13 Claims, 6 Drawing Sheets

DISK FOR TURBINE ENGINE

BACKGROUND OF THE INVENTION

1. Field of the Invention

The invention relates to a disk, such as used in turbines, and more particularly to slots defined in the disk for receiving a blade.

2. Description of Related Prior Art

A blade-disk assembly for a gas turbine engine includes a disk and a plurality of blades attached to a periphery of the disk. The blades can be attached to the disk by being individually inserted in slots that extend along the axis of rotation. Alternatively, the blades can be received in a single slot extending circumferentially around the periphery of the disk.

During the operation of the gas turbine engine, significant stresses can be generated in the slots of the disk. U.S. Pat. No. 5,141,401 is directed to alleviating stress peaking at a bearing surface interface of the blade and the slot in the disk. In the '401 patent, the slot is undercut to remove disk material and reduce the area of contact between the slot and the blade.

SUMMARY OF THE INVENTION

In summary, the invention is a disk for a turbine engine. The disk includes a rotatable body extending along a longitudinal axis between a forward side and an aft side. The disk also includes a plurality of slots disposed about a periphery of the body. Each of the slots extends between the forward and aft sides along a respective slot axis. The sides of each of the slots are asymmetrical relative to one another in a cross-section normal to the slot axis.

BRIEF DESCRIPTION OF THE DRAWINGS

Advantages of the present invention will be readily appreciated as the same becomes better understood by reference to the following detailed description when considered in connection with the accompanying drawings wherein.

DETAILED DESCRIPTION OF THE EXEMPLARY EMBODIMENT

The slot used for blade attachment can be the life-limiting feature of a disk. The slot experiences significant loads due to centrifugal force acting on the blade. In addition, the slot experiences tangential loading from forces generated by the interaction between the blade and the fluid passing across the blade. These different forms of loading can result in multiple points of stress concentration in the slot of the disk.

The exemplary embodiment of the invention addresses this by providing an asymmetrical slot. One side of the slot can be configured differently from the other so that stress is minimized on both sides of the slot. Stress distribution is improved to reduce the maximum stress value at any particular point in the slot. In the exemplary embodiment of the invention, a first side of the slot can have a circular fillet and a second side of the slot can have an elliptical fillet.

In many fields, the choice of shape for a fillet may be a matter of design choice, wherein a number of shape choices work equally well and any shape can be chosen without deliberation. However, the shape of any surface in a turbine engine, including fillets, cannot be characterized as a matter of design choice. The structures of turbine engine, including a disk, experience substantial loading and are the subject of substantial analysis and testing. Furthermore, the structures are often expected to withstand substantial loading without developing cracking that would be considered minimal in other fields due to safety requirements.

Figure 1:
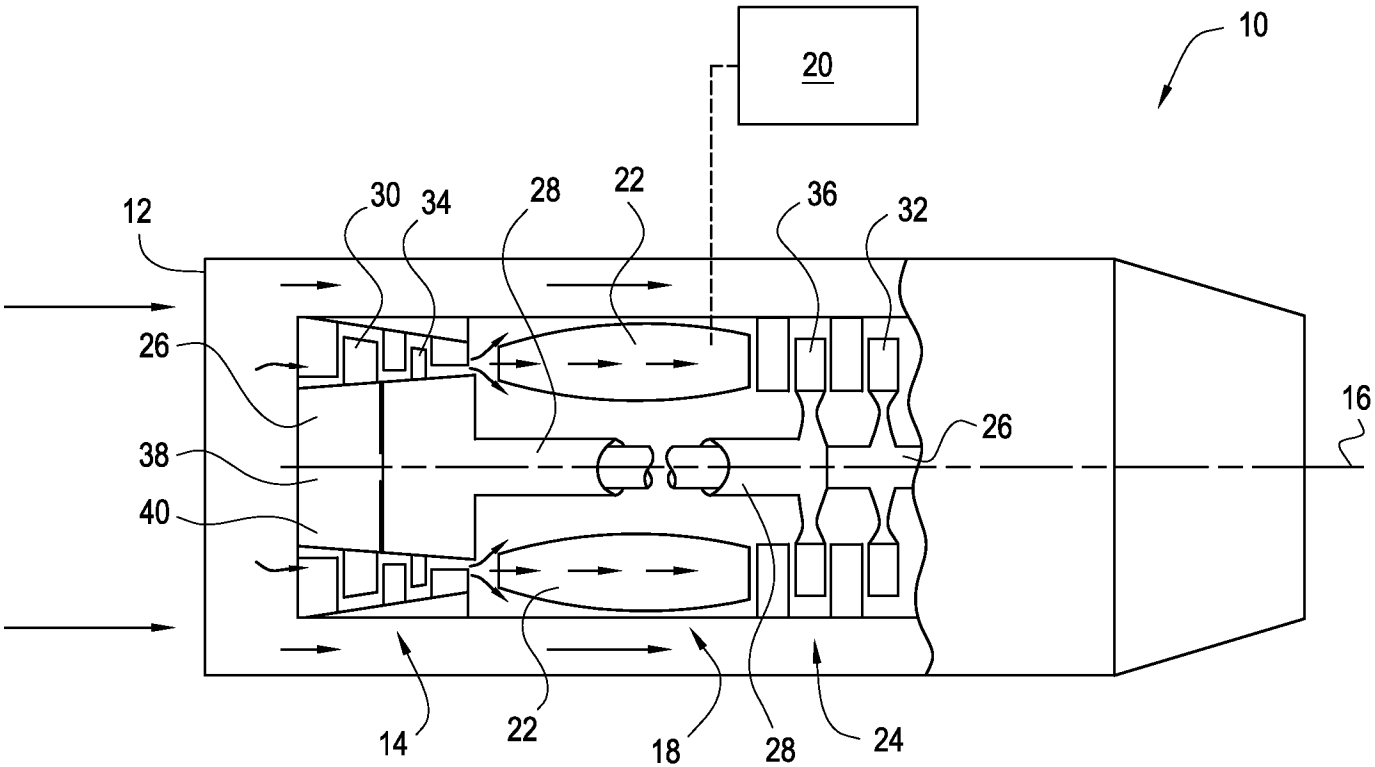
FIG. 1 is a schematic of a turbine engine which incorporates an exemplary embodiment of the invention.

FIG. 1 schematically shows a turbine engine 10. The various unnumbered arrows represent the flow of fluid through the turbine engine 10. The turbine engine 10 can produce power for several different kinds of applications, including vehicle propulsion and power generation, among others. The exemplary embodiments of the invention disclosed herein, as well as other embodiments of the broader invention, can be practiced in any configuration of turbine engine and in applications other than turbine engines in which torque is transmitted.

The exemplary turbine engine 10 can include an inlet 12 to receive fluid such as air. The turbine engine 10 may include a fan to direct fluid into the inlet 12 in alternative embodiments of the invention. The turbine engine 10 can also include a compressor section 14 to receive the fluid from the inlet 12 and compress the fluid. The compressor section 14 can be spaced from the inlet 12 along a centerline axis 16 of the turbine engine 10. The turbine engine 10 can also include a combustor section 18 to receive the compressed fluid from the compressor section 14. The compressed fluid can be mixed with fuel from a fuel system 20 and ignited in an annular combustion chamber 22 defined by the combustor section 18. The turbine engine 10 can also include a turbine section 24 to receive the combustion gases from the combustor section 18. The energy associated with the combustion gases can be converted into kinetic energy (motion) in the turbine section 24.

The shafts 26, 28 are shown disposed for rotation about the centerline axis 16 of the turbine engine 10. Alternative embodiments of the invention can include any number of shafts. The shafts 26, 28 can be journaled together for relative rotation. The shaft 26 can be a low pressure shaft supporting compressor blades 30 of a low pressure portion of the compressor section 14. The shaft 26 can also support low pressure turbine blades 32 of a low pressure portion of the turbine section 24.

The shaft 28 encircles the shaft 26. As set forth above, the shafts 26, 28 can be journaled together, wherein bearings are disposed between the shafts 26, 28 to permit relative rotation. The shaft 28 can be a high pressure shaft supporting compressor blades 34 of a high pressure portion of the compressor section 14. The shaft 28 can also support high pressure turbine blades 36 of a high pressure portion of the turbine section 24.

In the schematic view of FIG. 1, the illustrated shaft 26 can include a shaft portion 38 proximate to the centerline axis 16 and a disk portion 40 radially outward of the shaft portion 38. The compressor blades 30 can be mounted on the disk portion 40. The shaft portion 38 and the disk portion 40 are shown integral to one another to simplify the drawings. These structures can be separately formed and joined together by splines, could be press fit together, or could be joined in some other way for rotation together.

Figure 2:
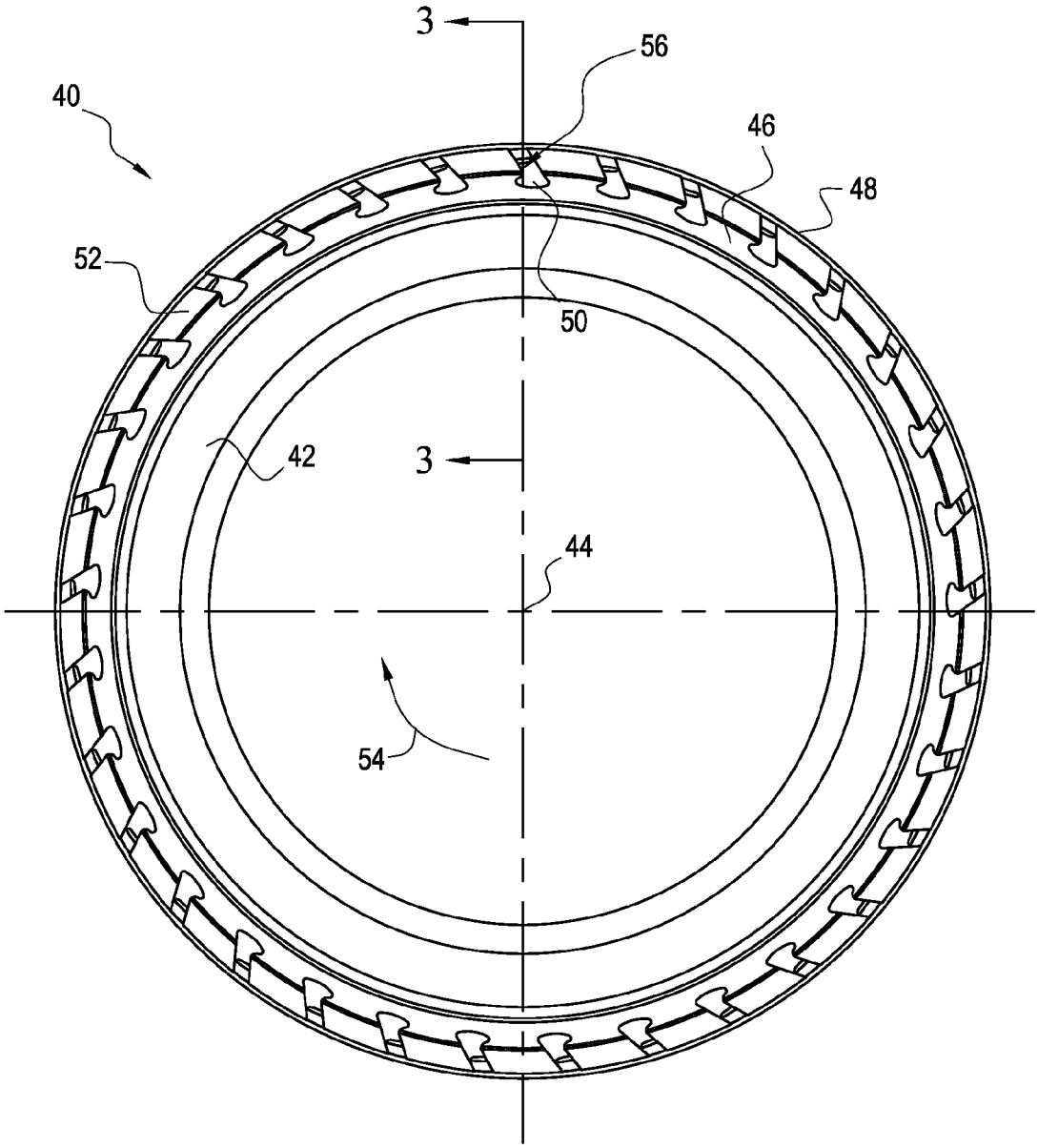
FIG. 2 is a front view of a disk according to an exemplary embodiment of the invention.
Figure 3:
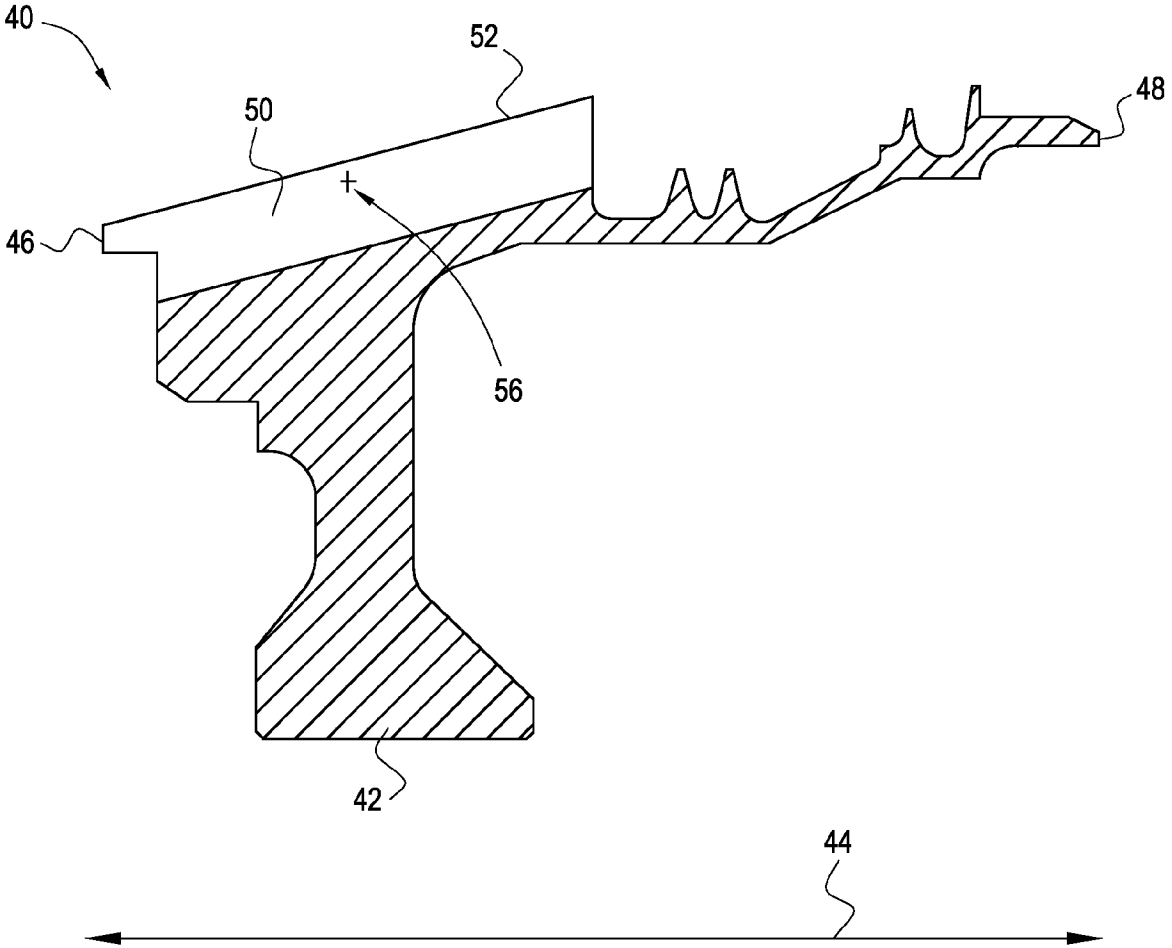
FIG. 3 is a cross-section taken along section lines 3-3 in FIG. 2.
Figure 4:
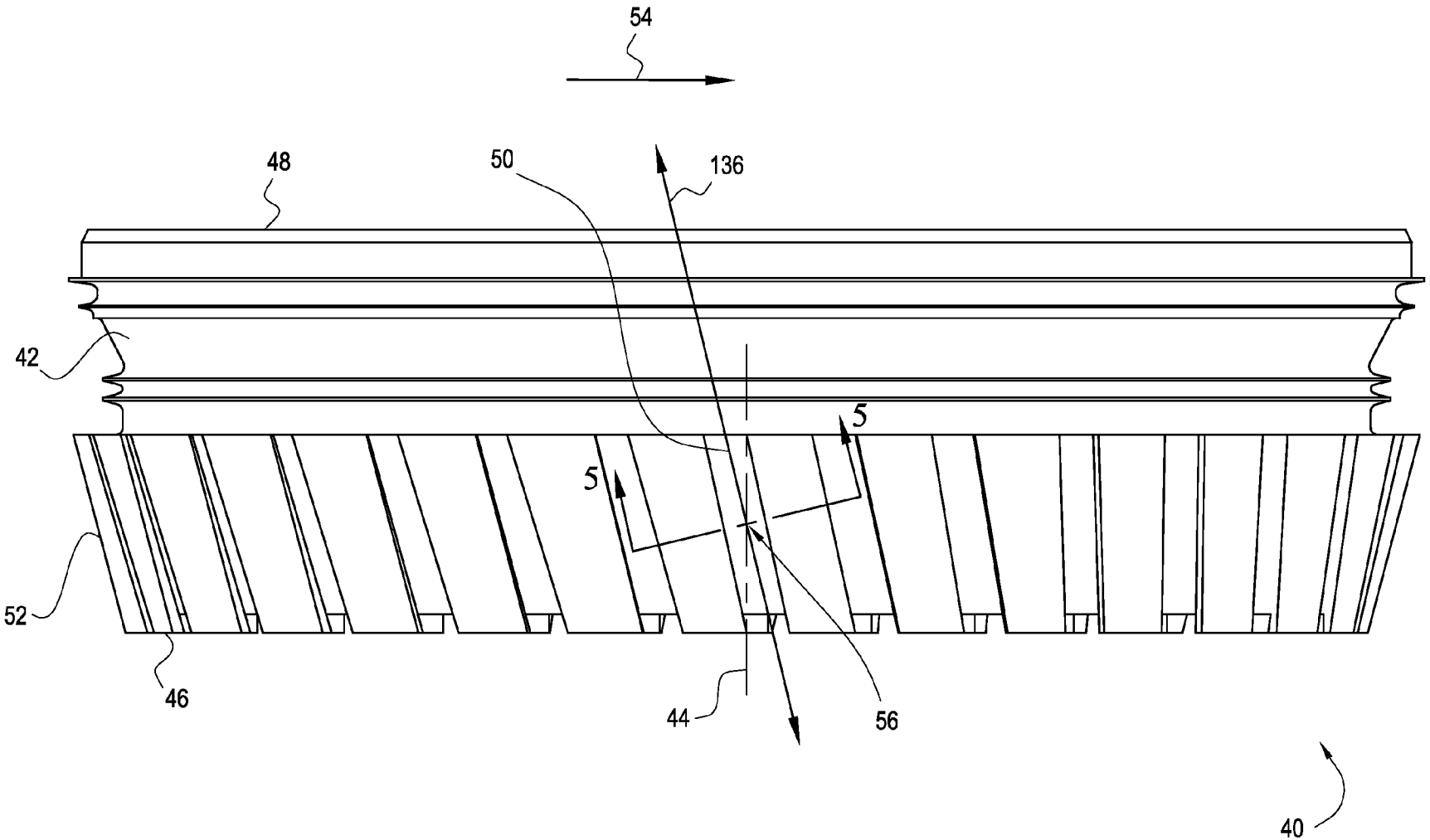
FIG. 4 is a top view of the disk according to an exemplary embodiment of the invention.

FIG. 2 shows a front view of the disk 40 according to the exemplary embodiment of the invention, FIG. 3 shows a partial cross-section of the disk 40, and FIG. 4 is top view. It is noted that all of the features of the disk 40 in FIGS. 2-4 are not requirements for practicing the invention. In alternative embodiments of the invention set forth in the claims, the disk 40 may be shaped differently.

FIGS. 2-4 show the disk 40 including a rotatable body 42 centered on a longitudinal axis 44. When the disk 40 is assembled in the turbine engine 10 (referenced in FIG. 1), the axis 44 is aligned with the centerline axis 16 (referenced in FIG. 1). The body 42 extends along the longitudinal axis 44 between a forward side 46 and an aft side 48. The disk 40 can be operable to rotate in an angular direction represented by arrow 54 (shown only in FIGS. 2 and 4). The disk 40 also includes a plurality of slots, such as slot 50, extending along respective slot axes, such as slot axis 136 (shown only in FIG. 4). The slots 50 are disposed about a periphery 52 of the body 42 and can receive a blade, such as blade 30 (referenced in FIG. 1). The blade received in the slot 50 would have a portion shaped to at least partially correspond to the shape of the slot 50. Each of the slots 50 is asymmetrical in a cross-section normal to its slot axis 136.

Figure 5:
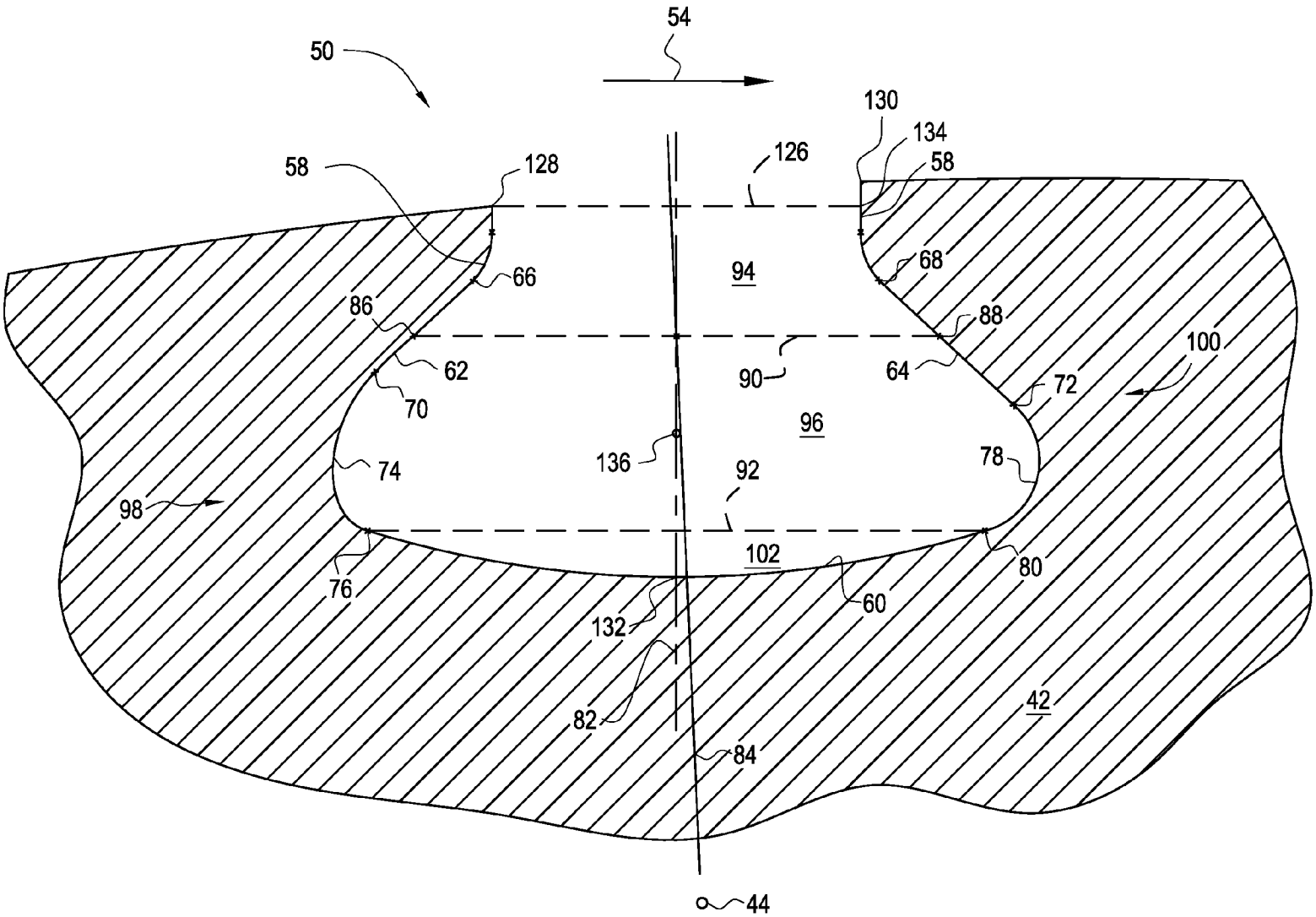
FIG. 5 is a cross-section taken along section lines 5-5 in FIG. 4.

FIG. 5 is a cross-sectional view of the exemplary slot 50. The view in FIG. 5 is in a plane normal to the slot axis 136. The exemplary cross-section of FIG. 5 is taken in a plane containing a point 56 shown in FIGS. 2-4. The point 56 can be approximately the midpoint of the slot 50, however the cross-section of the exemplary slot 50 can be the same along its entire axial length. It is noted that structure that would extend "behind" the cross-sectional plane of FIG. 5 (into the paper) is not shown to enhance the clarity of FIG. 5.

The exemplary slot 50 can include a neck portion 58 near a top of the slot 50 and a bottom portion 60. The exemplary slot 50 can also include first and second contact area portions 62, 64 extending between respective outer radial ends 66, 68 adjacent to the neck portion 58 and inner radial ends 70, 72 closer to the bottom portion 60. It is noted that the blade and the slot 50 can contact one another in the first and second contact area portions 62, 64 when the turbine engine 10 (referenced in FIG. 1) is running.

The exemplary slot 50 can also include a first fillet 74 extending between the inner radial end 70 of the first contact area portion 62 to an intersection point 76 with the bottom portion 60. The exemplary slot 50 can also include a second fillet 78 extending between the inner radial end 72 of the second contact area portion 64 to an intersection point 80 with the bottom portion 60.

The cross-section of the slot 50 defined in part by a central vertical axis 82 of the slot 50. The central vertical axis 82 is canted relative to the longitudinal axis 44. In other words, the central vertical axis 82 can extend in a plane normal to the longitudinal axis 44 without intersecting the longitudinal axis 44. A reference line 84 has been included in FIG. 5; the reference line is normal to the longitudinal axis 44.

The central vertical axis 82 of the slot 50 corresponds to a vertical axis of a tool used to form the slot 50, such as a broach bar. In other words, the vertical axis of the tool is aligned with the central vertical axis 82 when the slot 50 is being formed. In the art, the relative symmetry of a blade slot is defined by the shape of the slot on opposite sides of the central vertical axis of the slot, not the shape of the slot on opposite sides of a line extending normal to the axis of rotation. Symmetrical slots as found in the prior art can be formed with a tool, such as broach bar, that is symmetrical about its vertical axis along its entire length. When the slot is canted, the tool is canted or tilted during passage through/across the work-piece, but the tool is still symmetrical about its vertical axis and the slot is still viewed as symmetrical in the art.

The neck portion of a prior art slot that is canted appears asymmetrical but the slot is still viewed as symmetrical in the art. In FIG. 5, a reference line 126 is normal to the central vertical axis 82. Since the slot 50 is canted, the reference line 126 intersects one outer radial corner 128, but not the other outer radial corner 130. On opposite sides of the central vertical axis 82, the slot 50 includes a first side 98 and a second side 100. The first side 98 extends from the corner 128 to a midpoint 132 of the bottom portion 60. The first side 98 extends from the corner 128 to a midpoint 132 of the bottom portion 60. The second side 100 extends from a point 134 of intersection between the reference line 126 and the neck portion 58 to the midpoint 132. The slot 50 is asymmetrical because, the first and second sides 98, 100 are shaped differently from one another.

The exemplary slot 50 is asymmetrical and can therefore be formed with a broach bar that is asymmetrical about its vertical axis along at least a portion of its length. In the exemplary embodiment of the invention, the asymmetry can be localized in a central portion of the slot 50 as described more fully below. In alternative embodiments of the invention, the slot may be characterized by asymmetry of a different nature.

The exemplary slot 50 can include a first portion 94 that is symmetrical about the central vertical axis 82. The exemplary first portion 94 can extend radially inward from the corner 128 and intersection point 132 to respective midpoints 86, 88 of the first and second contact area portions 62, 64. A dashed reference line 90 is shown in FIG. 5 and the first portion 94 is above the dashed reference line 90. The line 90 is normal to the central vertical axis 82. In alternative embodiments of the invention, the slot 50 could be symmetrical radially inward from the corner 128 and intersection point 132 to the inner radial ends 70, 72. In the exemplary slot 50, the distance between the midpoint 88 and inner radial end 72 can be slightly longer than the distance between the midpoint 86 and inner radial end 70.

The exemplary slot 50 can also include a second portion 96 adjacent to and positioned radially inward of the first portion 94. The second portion 96 of the exemplary slot 50 is asymmetrical about the central axis 82. The second portion 96 of the exemplary slot 50 extends from the midpoints 86, 88 to the intersection points 76, 80. A dashed reference line 92 is shown in FIG. 5 and the second portion 96 defined between the dashed reference lines 90 and 92. The line 92 is normal to the central vertical axis 82.

The exemplary second portion 96 can include the first fillet 74 on the first side 98 and the second fillet 78 on the second side 100. In the exemplary embodiment of the invention, the first fillet 74 can be elliptical and the second fillet 78 can be circular. The body 42 is operable to rotate about the longitudinal axis 44 in the angular direction represented by the arrow 54 and the second side 100 leads the first side 98 relative to the direction of rotation. The selection of an elliptical fillet 74 on the first side 98 of the slot 50 and a circular fillet 78 on the other side 100 of the slot 50 in the exemplary embodiment of the invention has been found to significantly increase the operating life of the body 42. In one embodiment, the asymmetrical slot substantially doubled operating life.

The exemplary slot 50 can also include a third portion 102 adjacent to and positioned radially inward of the second portion 96. The third portion 102 can be symmetrical about the central axis 82. The third portion 102 can be defined between the reference line 92 and the bottom portion 60. The exemplary bottom portion 60 can be scalloped.

Figure 6:
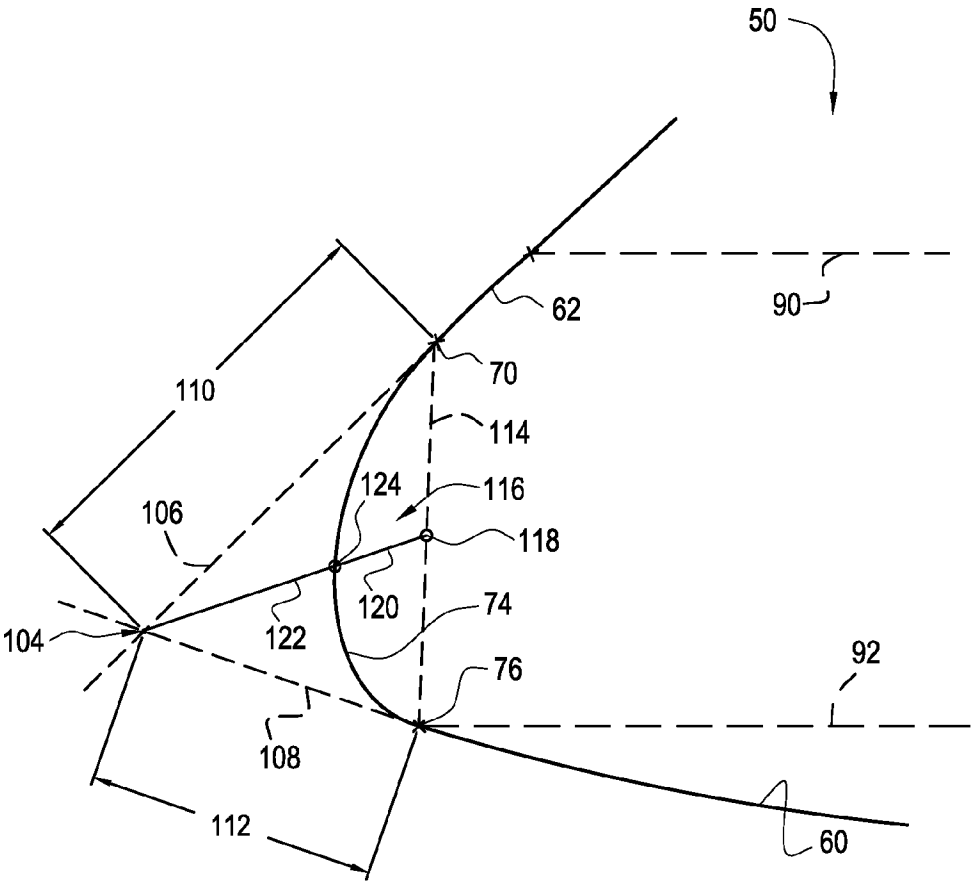
FIG. 6 is a magnified portion of FIG. 5.

An optimized ellipse can be selected for the elliptical fillet 74 to reduce the level of stress at a particular point in the first area contact portion 62 and the elliptical fillet 74. The ellipse of the elliptical fillet 74 can be defined by a plurality of factors. Referring now to FIG. 6, the ellipse can be defined in part by an apex point 104. The apex point 104 is the intersection of a first line 106 extending tangent to the first contact area portion 62 from the inner radial end 70 and a second line 108 extending tangent to the bottom portion 60 from the intersection point 76.

The ellipse can also be defined in part by a first offset. The first offset is represented by arrow 110 and is the distance along the first line 106 between the inner radial end 70 and the apex point 104. The ellipse can also be defined in part by a second offset. The second offset is represented by arrow 112 and is the distance along the second line 108 between the apex point 104 and the intersection point 76.

The ellipse can also be defined in part by a chord 114 extending between the inner radial end 70 and the intersection point 76. The ellipse can also be defined in part by a third line 116 extending between a midpoint 118 of the chord 114 and the apex point 104. The third line 116 can include two components, a first depth represented by arrow 120 and second depth represented by arrow 122. The first depth 120 is the distance along the third line 116 between the midpoint 118 and an intersection point 124 of the elliptical fillet 74 and the third line 116. The second depth 122 is the distance along the third line 116 between the apex point 104 and the intersection point 124.

The ellipse can also be defined in part by a dimensionless depth characteristic. The dimensionless depth characteristic can be equal to the first depth 120 divided by the sum of the first depth 120 and the second depth 122:

(first depth 120)/((first depth 120)+(second depth 122))

In an exemplary method for selecting the ellipse, a plurality of different potential ellipses can be derived by varying at least some of the factors in order to evaluate different potential stress fields. Each ellipse can be evaluated by applying finite element analysis to a slot design including the particular ellipse. In one method of varying factors, the first offset 110 can be held constant during the deriving step. The first offset 110 can be held constant so that the contact area between the blade and the slot 50 is not reduced below a particular value.

The deriving step can be done in two stages. In a first stage, the dimensionless depth characteristic and the first offset 110 can be held constant while the second offset 112 is varied to generate a plurality of different potential ellipses. Each ellipse derived in the first stage of the deriving step can be assessed by applying finite element analysis to a slot design including the particular ellipse. By way of example and not limitation, seven different values for the second offset can be applied to generate seven different ellipses and seven different potential slot designs. Each slot design can be subjected to finite element analysis to determine the location and severity of maximum stress. A final value for the second offset 112 can be chosen such that the final value corresponds to the slot design having lowest maximum stress localized generally in the first area contact portion 62 and the elliptical fillet 74.

In a second stage of the deriving step, the second offset can be held constant at the final value determined during the first stage of the deriving step. The dimensionless depth characteristic can then be varied during the second stage to derive a plurality of different potential ellipses. By way of example and not limitation, seven different values for the dimensionless depth characteristic can be applied to generate seven different ellipses and seven different potential slot designs. Each slot design can be subjected to finite element analysis to determine the location and severity of maximum stress. A final value for the dimensionless depth characteristic can be chosen such that the final value corresponds to the lowest maximum stress localized generally in the first area contact portion 62 and the elliptical fillet 74. Thus, after the two stages of the deriving step, an optimized ellipse can be selected for the elliptical fillet 74.

The turbine engine 10 shown in FIG. 1 can include at least one disk 40 as described above. The disk 40 can define a single stage of the multi-stage compressor section 14 of the turbine engine 10. The invention can also be practiced by incorporating the disk 40 having an asymmetrical axial slot in the turbine section of a turbine engine. The multi-stage compressor section 14 of the turbine engine 10 can include more than one disks 40 having asymmetrical axial slots. In such an embodiment, each disk 40 would likely be somewhat different from one another since the length of blades at each compressor stage is usually different. In one embodiment, the multi-stage compressor section 14 of the turbine engine 10 can include disks 40 having asymmetrical axial slots as stages 2 through 4. The multi-stage compressor section 14 of the turbine engine 10 can also include other disks without asymmetrical slots for other stages of compression. For example, the multi-stage compressor section 14 can include disks having asymmetrical slots for stages 2-4 and disks having symmetrical slots for the remaining stages of compression.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A disk for a turbine engine comprising:

a rotatable body extending along a longitudinal axis between a forward side and an aft side; and a plurality of slots disposed about a periphery of said body, each extending between said forward and aft sides along a respective slot axis and each having first and second sides that are peripherally opposite one another, wherein the first and second sides of each of said slots are asymmetrical relative to one another in a cross-section normal to said slot axis and asymmetrical about an axis projecting radially from the longitudinal axis.

2. The disk of claim 1 wherein said cross-section includes a central axis normal to said slot axis and canted relative to said longitudinal axis, and the first and second sides are asymmetrical about said central axis, and wherein said cross-section includes the first side having an elliptical fillet and the second side opposite said first side having a circular fillet.

3. The disk of claim 2 wherein said body is operable to rotate about said longitudinal axis in a first angular direction and wherein said second side leads said first side relative to said first angular direction.

4. The disk of claim 1 wherein said cross-section further comprises:

a central axis normal to said slot axis and canted relative to said longitudinal axis;

a first portion symmetrical about said central axis; and a second portion adjacent to said first portion and asymmetrical about said central axis.

5. The disk of claim 4 wherein said second portion is positioned radially inward of said first portion.

6. The disk of claim 4 wherein said cross-section further comprises:

a third portion symmetrical about said central axis and positioned radially inward of said second portion.

7. The disk of claim 1 wherein each of said slots further comprises:

a scalloped bottom disposed closest to said longitudinal axis;

a circular fillet extending from a first side of said scalloped bottom; and an elliptical fillet extending from a second side of said scalloped bottom.

8. A turbine engine comprising at least one disk according to claim 1.

9. The turbine engine of claim 8 wherein said disk is further defined as a component of a multi-stage compressor section.

10. The turbine engine of claim 9 further defined as including a first plurality of said disks in said multi-stage compressor section.

11. The turbine engine of claim 10 wherein said first plurality of disks define only stages 2 through 4 of said multi-stage compressor section.

12. The turbine engine of claim 8 further defined as including a first plurality of said disks.

13. The turbine engine of claim 8 further comprising:

at least one second disk having slots differently configured than said slots of said disk.

* * * * *